US009751225B2

(12) United States Patent
Man Wong et al.

(10) Patent No.: US 9,751,225 B2
(45) Date of Patent: Sep. 5, 2017

(54) ELECTRIC STUBBLE TRIMMER

(71) Applicant: Raymond Industrial Ltd., Shatin (HK)

(72) Inventors: John Ying Man Wong, Shatin (HK); Anthony Kowk Yung Law, Tai Po (HK)

(73) Assignee: RAYMOND INDUSTRIAL LTD., Shatin (HK)

( * ) Notice: Subject to any disclaimer, the term of this patent is extended or adjusted under 35 U.S.C. 154(b) by 143 days.

(21) Appl. No.: 14/493,793

(22) Filed: Sep. 23, 2014

(65) Prior Publication Data

US 2016/0082606 A1 Mar. 24, 2016

(51) Int. Cl.
*B26B 19/06* (2006.01)
*B26B 19/38* (2006.01)

(52) U.S. Cl.
CPC ..... *B26B 19/06* (2013.01); *B26B 19/3846* (2013.01)

(58) Field of Classification Search
CPC .... B26B 19/06; B26B 19/384; B26B 19/3846
USPC ..... 30/43.9, 43.92, 346.51
See application file for complete search history.

(56) References Cited

U.S. PATENT DOCUMENTS 2,590,452 A * 3/1952 Peterson ..... B26B 19/26 30/34.2
2,827,693 A * 3/1958 Kobler ..... B26B 19/04 30/43.92
3,002,276 A * 10/1961 Kobler ..... B26B 19/042 30/346.51
4,003,130 A * 1/1977 Rookus ..... B26B 19/42 30/34.2
4,133,103 A * 1/1979 Beck ..... B26B 19/12 30/346.51
4,139,940 A * 2/1979 Buras, Jr. ..... B26B 19/42 30/346.51
5,884,404 A * 3/1999 Ohle ..... B26B 19/044 30/346.51
5,893,211 A * 4/1999 Hotani ..... B26B 19/06 30/346.51
5,946,806 A * 9/1999 Watanabe ..... B26B 19/042 30/346.51
6,178,641 B1 * 1/2001 Meijer ..... B26B 19/042 30/346.51
7,022,195 B2 * 4/2006 Otani ..... B26B 19/044 148/527
7,237,339 B2 * 7/2007 Parsonage ..... B26B 19/10 30/34.1
9,289,907 B2 * 3/2016 Wong ..... B26B 19/384
2007/0044314 A1 * 3/2007 Okabe ..... B26B 19/044 30/44

(Continued)

FOREIGN PATENT DOCUMENTS

EP 1216799 B1 12/2001

*Primary Examiner* — Hwei C Payer
(74) *Attorney, Agent, or Firm* — Miller, Matthias & Hull LLP

(57) ABSTRACT

An outer cutter for an electric trimmer may include a frame having first and second end sections. A plurality of outer cutter ribs may be disposed between the first and second end sections. Each outer cutter rib of the plurality of outer cutter ribs may include a cutting surface and an outer surface. The outer surface may include a glide surface disposed between first and second sides of the outer cutter surface. The plurality of outer cutter ribs may have a stubble trimmer value of at least 3.

7 Claims, 4 Drawing Sheets

(56) References Cited

U.S. PATENT DOCUMENTS

| | | | | |
|---|---|---|---|---|
| 2007/0245565 | A1* | 10/2007 | Sato | B26B 19/04 30/43.92 |
| 2008/0168662 | A1 | 7/2008 | Mikula et al. | |
| 2010/0212160 | A1* | 8/2010 | Liu | B26B 19/042 30/43.92 |
| 2013/0042487 | A1 | 2/2013 | Julemont | |
| 2015/0314461 | A1* | 11/2015 | Man Wong | B26B 19/042 30/43.91 |
| 2016/0039102 | A1* | 2/2016 | Shimizu | B26B 19/102 30/34.1 |
| 2016/0082606 | A1* | 3/2016 | Man Wong | B26B 19/06 30/208 |

* cited by examiner

ELECTRIC STUBBLE TRIMMER

TECHNICAL FIELD

The present disclosure relates generally to electric trimmers and, more particularly, to cutting heads.

BACKGROUND

Grooming and trimming facial hair can be quite a task for a person when factoring in the length of hair to be trimmed and the desired style of hair to be left behind. In some instances, ordinary scissors may be used to trim the facial hair, but is often overly time consuming and usually leaves an uneven layer of facial hair. Most common electric shavers are also unsuitable or overly difficult to use for trimming because either the facial hair to be trimmed is too long and cannot be cut by the electric shaver or the electric shaver removes much more facial hair than desired.

Another option for grooming and trimming facial hair is a hair/beard trimmer. Traditional beard trimmers generally include an open trimmer and an attachable comb portion. The attachable comb portion typically includes a set of teeth that help direct the hair towards the open trimmer. While the attachable comb portion also acts as a guard to trim the hair to a desired length, the teeth are commonly wide set with a significant gap between teeth resulting in some hair missing the open trimmer during a trimming pass of the electric trimmer. In light of this, it may take a few passes of the electric trimmer over the same area to trim the majority of the hair there. But even with a few passes over the same area, some hair may still be missed because of the gap between teeth, thus resulting in uneven trimmed hair. The user may be forced to pull the hair taut with his free hand and attempt another pass to capture the hair through the teeth for trimming. While possibly effective, this requires the user to search for untrimmed hair with his fingers, look in a mirror, and make an awkward pass of the electric trimmer while pulling the untrimmed hair taut. This precise handling of the electric trimmer can be quite time consuming and still has the potential, because of the significant gap between the teeth of the comb portion, for the skin surface to come into direct contact with the blades of the open trimmer causing nicking of the skin.

SUMMARY

In accordance with an aspect of the disclosure, an outer cutter for an electric trimmer is provided. The outer cutter may include a frame having first and second end sections. A plurality of outer cutter ribs may be disposed between the first and second end sections. Each outer cutter rib of the plurality of outer cutter ribs may include a cutting surface and an outer surface. The outer surface may include a glide surface disposed between first and second sides of the outer cutter surface. The plurality of outer cutter ribs may have a stubble trimmer value of at least 3.

In accordance with another aspect of the disclosure, the cutting surface may include at least a first cutting edge.

In accordance with yet another aspect of the disclosure, the glide surface may be parallel to the cutting surface.

In accordance with still yet another aspect of the disclosure, the first side may transition into the glide surface arcuately. The second side may include a notch that may transition into the glide surface. The glide surface may incline from the first side to the notch. Adjacent outer cutter ribs of the plurality of outer cutter ribs may be alternately orientated so that the first and second sides of one outer cutter rib may be proximate the second and first sides of its adjacent outer rib, respectively.

In further accordance with another aspect of the disclosure, the first side may transition into the glide surface arcuately. The second side may transition into the glide surface arcuately. The glide surface may incline from the first side to the second side.

In further accordance with yet another aspect of the disclosure, adjacent outer cutter ribs of the plurality of outer cutter ribs may be alternately orientated so that the first and second sides of one outer cutter rib is proximate the second and first sides of its adjacent outer cutter rib, respectively.

In further accordance with still yet another aspect of the disclosure, the first side may include a first chamfer coupled to the glide surface. The second side may include a second chamfer coupled to the glide surface. The glide surface may curve inwardly toward the cutting surface.

In accordance with another aspect of the disclosure, an electric trimmer having an electric motor is provided. The electric trimmer may include a head. The electric trimmer may also include at least a first linear cutter disposed on the head. The at least first linear cutter may include an inner cutter having a plurality of inner cutter ribs. The outer cutter may have a plurality of outer cutter ribs. The plurality of inner cutter ribs may be mechanically associated with the plurality of outer cutter ribs. The plurality of outer cutter ribs may have a stubble trimmer value of at least 3.

In accordance with still another aspect of the disclosure, each inner cutter rib of the plurality of inner cutter ribs may include at least one inner cutter cutting edge. Each outer cutter rib of the plurality of outer cutter ribs may include a cutting surface having at least one outer cutter cutting edge. The at least one outer cutter edge may be orientated at a first angle and the at least one inner cutter cutting edge may be orientated at a second angle. The second angle may be correspondingly oppositely-facing the first angle.

In accordance with yet another aspect of the disclosure, the at least one outer cutter cutting edge may have a first unit of hardness that differs from a second unit of hardness of the at least one inner cutter cutting edge.

In accordance with still yet another aspect of the disclosure, each outer cutter rib of the plurality of outer cutter ribs may include an outer surface having a first side, a second side, and a glide surface coupled therebetween.

In accordance with another aspect of the disclosure, an electric trimmer having an electric motor is provided. The electric trimmer may include a head. The electric trimmer may also include at least a first linear cutter disposed on the head. The at least first linear cutter may include an inner cutter having a plurality of inner cutter ribs and an outer cutter having a plurality of outer cutter ribs. The plurality of inner cutter ribs may be mechanically associated with the plurality of outer cutter ribs forming an enclosed trimming region. Each of the outer cutter ribs may include a cutting surface and an outer surface. The outer surface may include a glide surface disposed between first and second sides of the outer surface. Each of the outer cutter ribs may have a depth of at least 0.4 millimeters.

Other aspects and features of the disclosed systems and methods will be appreciated from reading the attached detailed description in conjunction with the included drawing figures. Moreover, selected aspects and features of one example embodiment may be combined with various selected aspects and features of other example embodiments.

BRIEF DESCRIPTION OF THE DRAWINGS

For further understanding of the disclosed concepts and embodiments, reference may be made to the following detailed description, read in connection with the drawings, wherein like elements are numbered alike, and in which.

It is to be noted that the appended drawings illustrate only typical embodiments and are therefore not to be considered limiting with respect to the scope of the disclosure or claims. Rather, the concepts of the present disclosure may apply within other equally effective embodiments. Moreover, the drawings are not necessarily to scale, emphasis generally being placed upon illustrating the principles of certain embodiments.

DETAILED DESCRIPTION

Figure 1:
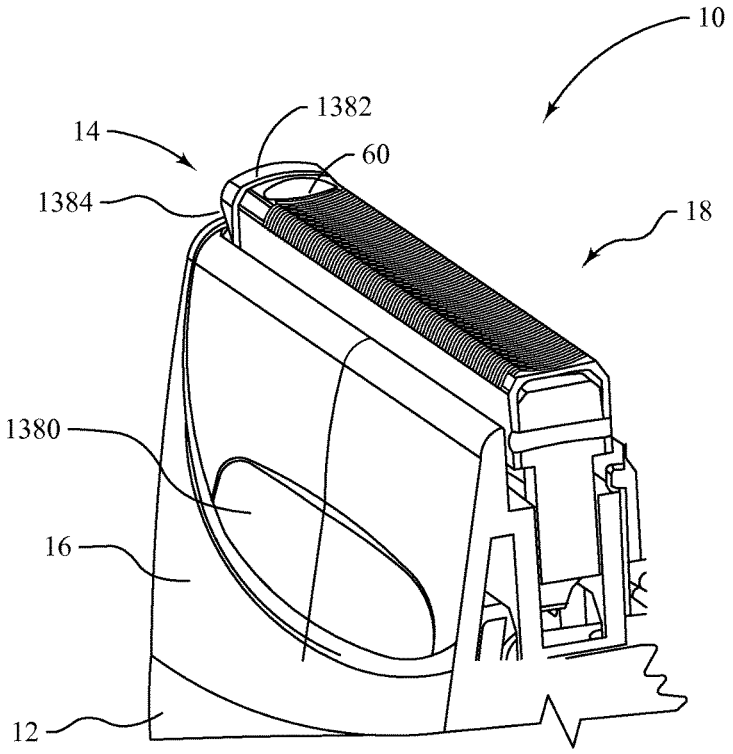
FIG. 1 is a perspective view of an electric trimmer with portions sectioned and broken away to show details of the present disclosure.

Referring now to FIG. 1, an electric trimmer constructed in accordance with the present disclosure is generally referred to by reference numeral 10. The electric trimmer 10 includes a body 12 and a trimmer head 14 disposed thereon. A protective casing 16 encases the trimmer head 14. The trimmer head 14 includes a linear cutter 18. Although one linear cutter 18 is shown, it is within the scope of the disclosure that the trimmer head 14 may include multiple linear cutters. An electric motor (not shown) may be housed within the body 12 and may be in mechanical association with an eccentric pin, which drives the linear cutter 18.

Figure 2:
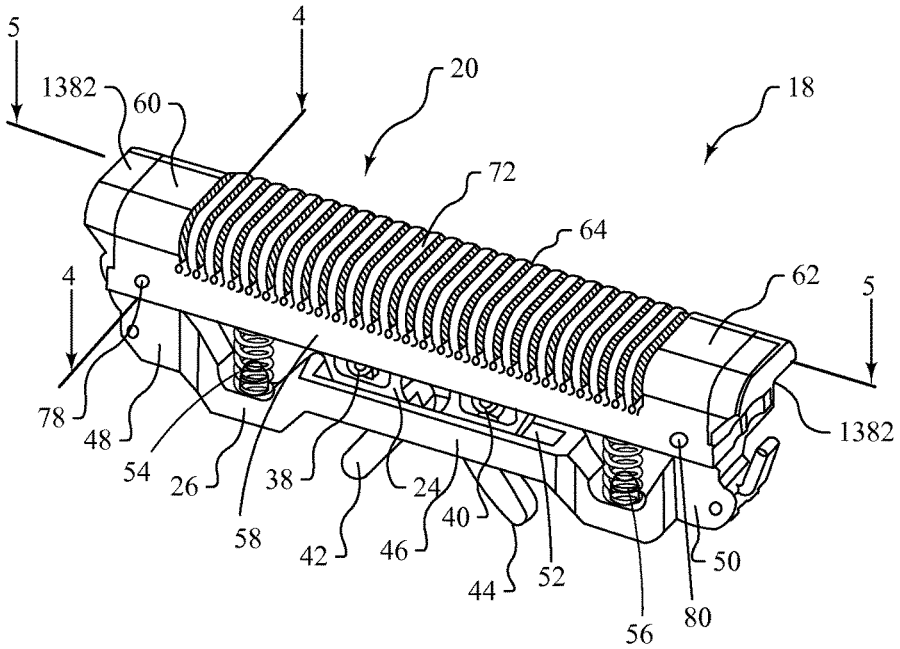
FIG. 2 is a perspective view of a linear cutter, constructed in accordance with the teachings of this disclosure.
Figure 3:
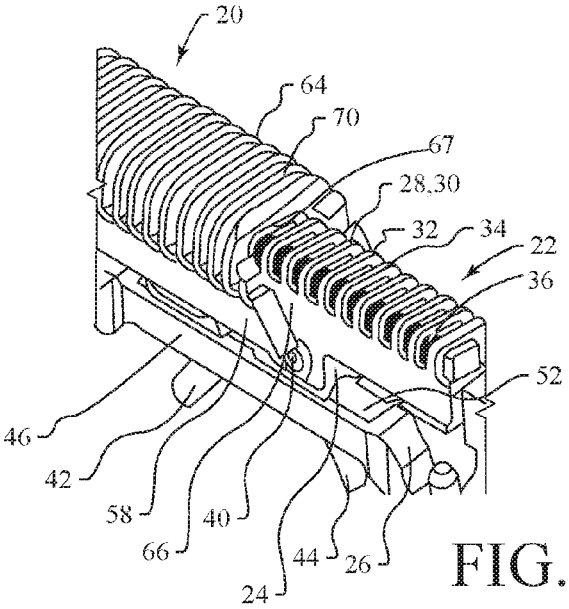
FIG. 3 is a perspective view of a linear cutter with portions sectioned and broken away to show details in accordance with the teachings of this disclosure.

As best seen in FIGS. 2-3, the linear cutter 18 includes an outer cutter 20, a linear inner cutter 22, a linear inner cutter carrier 24, and a frame 26. The linear inner cutter 22 includes a plurality of inner cutter ribs 28. Each inner cutter rib 28 may have an arch-like shape with a flat cutting surface 30. Each flat cutting surface 30 may have first and second inner cutting edges 32, 34. Moreover, each inner cutter rib 28 is equally spaced apart so that an inner cutter slot 36 is formed between adjacent inner cutter ribs 28.

The linear inner cutter 22 may be coupled to the linear inner cutter carrier 24, for example, with a first and second heat melt rivet 38, 40 or with other similar techniques known in the industry. The linear inner cutter carrier 24 may also include opposing fingers 42, 44, which are mechanically associated with the frame 26. The frame 26 may include a base 46 disposed between first and second arms 48, 50. The base 46 includes a channel 52, which mechanically receives the opposing fingers 42, 44 of the linear inner cutter carrier 24. A first spring 54 may extend from the base 46 adjacent to the first arm 48 and a second spring 56 may extend from the base 46 adjacent to the second arm 50.

Figure 4:
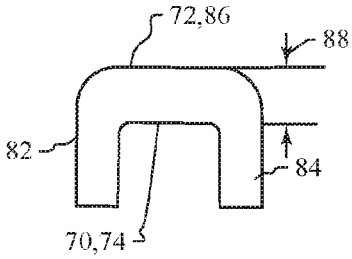
FIG. 4 is a cross-sectional view taken along line 4-4 of the outer cutter of FIG. 2, constructed in accordance with the teachings of this disclosure.

The outer cutter 20 includes an outer cutter frame 58. The outer cutter frame 58 includes first and second end sections 60, 62 with a plurality of outer cutter ribs 64 disposed therebetween. The outer cutter 20 includes a longitudinal passage 66, which operatively receives the linear inner cutter 22 to form an enclosed trimmer region 67. Each outer cutter rib 64 is equally spaced apart so that an outer cutter slot 68 is formed between adjacent outer cutter ribs 64. Moreover, each outer cutter rib 64 includes an inward cutting surface 70 facing the longitudinal passage 66 and an outer surface 72, as best seen in FIG. 4. The inward cutting surface 70 may include first and second cutting edges 74, 76.

When the linear cutter 18 is fully assembled the outer cutter 20 is coupled to the first and second end sections 60, 62 of the frame 26 by corresponding first and second lock pins 78, 80, respectively, so that the linear inner cutter 22 operatively fits within the longitudinal passage 66 and is urged into close mechanical association with the outer cutter 20 by the even force of the first and second springs 54, 56 against the linear inner cutter carrier 24. Moreover, the first and second cutting edges 74, 76 of the outer cutter 20 may be arranged to slant oppositely to the first and second inner cutting edges 32, 34 of the inner cutter 22 such that, during operation, the cutting edges 32, 34, 74, 76 operate like scissors. In particular, the first and second cutting edges 74, 76 may be at a slant angle between 5 and 30 degrees from the inward cutting surface 70 and the first and second inner cutting edges 32, 34 may be at a corresponding oppositely-facing slant angle between 5 and 30 degrees from the flat cutting surface 30. A pitch ratio between the outer cutter 20 and the linear inner cutter 22 may be approximately 2.5 to 3. The cutting edges 32, 34, 74, 76 may be hardened to over 56 HRC. The first and second cutting edges 74, 76 may be of a different hardness, greater than 56 HRC, than the first and second inner cutting edges 32, 34 so that, during operation, the cutting edges 74, 76 self-sharpen the inner cutting edges 32, 34, and vice versa. Furthermore, the first and second cutting edges 74, 76 of the outer cutter 20 may be, but not limited to, stainless steel, which may be coated with, but not limited to, titanium or diamond-like carbon.

Figure 5:
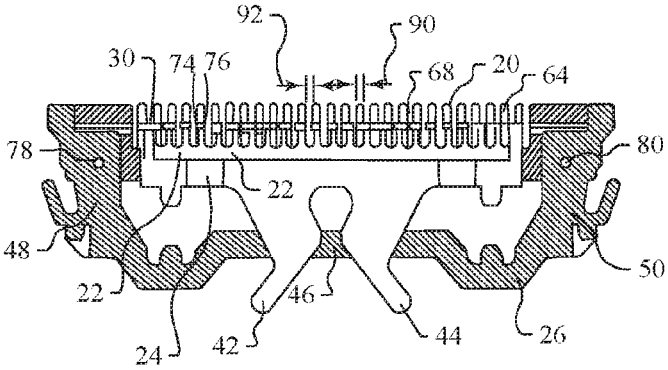
FIG. 5 is a cross-sectional view taken along line 5-5 of the linear cutter of FIG. 2, constructed in accordance with the teachings of this disclosure.

As illustrated in FIGS. 4-5, the outer surface 72 of each outer cutter rib 64 may have an arch-like profile that includes first and second sides 82, 84 and a flat glide surface 86 therebetween that is parallel to the inward cutting surface 70.

The first side 82 may transition into the flat glide surface 86 so that the intersection is arcuate. Similarly, the second side 84 may transition into the flat glide surface 86 so that the intersection is also arcuate. Each outer cutter slot 68 may form a space between adjacent outer cutter ribs 64 that extends adjacently from each first side 82 along each glide surface 86 and along each second side 84. Alternatively, each outer cutter slot 68 may form a space between adjacent cutter ribs 64 that extends adjacently from each first side 82 along each glide surface 86, but terminates proximate each second side 84 such that a space is not formed between second sides 84 of adjacent outer cutter ribs 64. Each outer cutter rib 64 has a depth 88 and a width 90. The depth 88 is measured approximately from the inward cutting surface 70 to the flat glide surface 86 of the outer surface 72. In particular, the depth 88 may be sized to facilitate trimming facial hair while leaving a stubble length. For example, the depth 88 may be in the range of approximately 0.4 millimeters to 3 millimeters. Moreover, the width 90 may be in the range of approximately 0.13 millimeters to 1 millimeter. Each outer cutter slot 68 may have a width 92 in the range of approximately 0.6 millimeters to 0.8 millimeters. A stubble trimmer value, which is defined as the ratio of the depth 88 to the width 90, is designed to provide a user with a uniform layer of stubble without nicking the skin of the user. The stubble trimmer value achieves the desired effect of providing a uniform layer of stubble without nicking the skin by disentangling hairs so that each hair strand is individually cut, while at the same time, the cutting surfaces 30, 70 are kept away at a proper distance to avoid contact with the skin. The plurality of outer cutter ribs 64 of the outer cutter 20 having a stubble trimmer value of at least 3 is found to provide the desired uniform layer of stubble while preventing the linear inner cutter 22 from making contact with the skin of a user. A stubble trimmer value that is less than 3 cannot provide a proper distance between the skin and the cutting surfaces 30, 70 likely resulting in unavoidable nicking of the skin.

Figure 6:
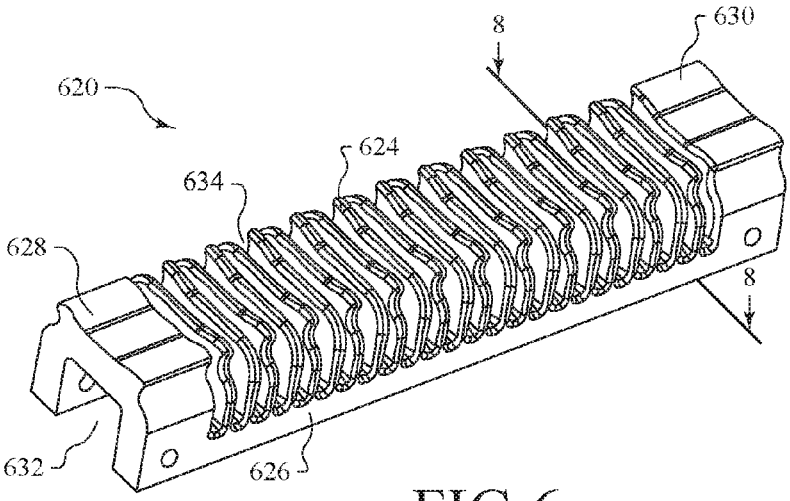
FIG. 6 is a perspective view of an alternative embodiment of an outer cutter, constructed in accordance with the teachings of this disclosure.
Figure 7:
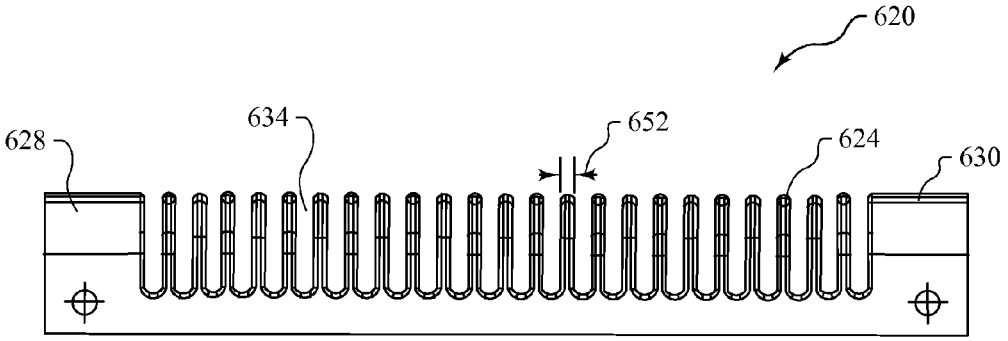
FIG. 7 is a front view of the outer cutter of FIG. 6, constructed in accordance with the teachings of this disclosure.
Figure 8:
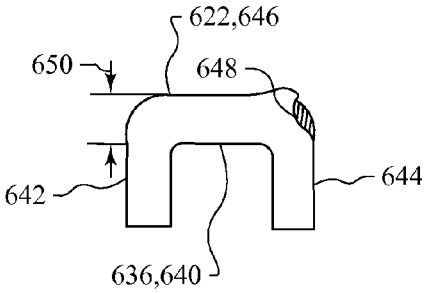
FIG. 8 is a cross-sectional view taken along line 8-8 of the outer cutter of FIG. 6, constructed in accordance with the teachings of this disclosure.

FIGS. 6-8 illustrate an example alternative embodiment outer cutter 620, which may be utilized instead of the outer cutter 20 described above. The outer cutter 620 is similar to the outer cutter 20 except the profile of an outer surface 622 of each outer cutter rib of the plurality of outer cutter ribs 624 differs from that of the outer cutter 20, and as such, will be described in more detail below. The outer cutter 620 includes an outer cutter frame 626. The outer cutter frame 626 includes first and second end sections 628, 630 with the plurality of outer cutter ribs 624 disposed therebetween. The outer cutter 620 includes a longitudinal passage 632, which operatively receives the liner inner cutter 24 (shown in FIG. 3). Each outer cutter rib 624 may be equally spaced apart so that an outer cutter slot 634 is formed between adjacent outer cutter ribs 624. Moreover, each outer cutter rib 624 includes an inward cutting surface 636 facing the longitudinal passage 632. The inward cutting surface 636 may include cutting edges 640.

The outer surface 622 of each outer cutter rib 624 includes a first and second side 642, 644 and a sloped glide surface 646 therebetween. The first side 642 may transition into the sloped glide surface 646 so that the intersection is arcuate. The second side 644 includes a notch 648 which may transition into the sloped glide surface 646. The sloped glide surface 646 inclines from the first side 642 toward the notch 648. The orientation of adjacent outer cutter ribs 624 alternate so that the notch 648 of one outer cutter rib 624 is proximate to the first side of an adjacent outer cutter rib while the first side 642 of the former outer cutter rib is proximate to the notch of the adjacent outer cutter rib, as best shown in FIG. 6. Each outer cutter rib 624 has a depth 650 and a width 652. The depth 650 may be measured approximately from the inward cutting surface 636 to the sloped glide surface 646 adjacent the first side 642. The plurality of outer cutter ribs 624 of the outer cutter 620 may also include a stubble trimmer value that is at least 3.

Figure 9:
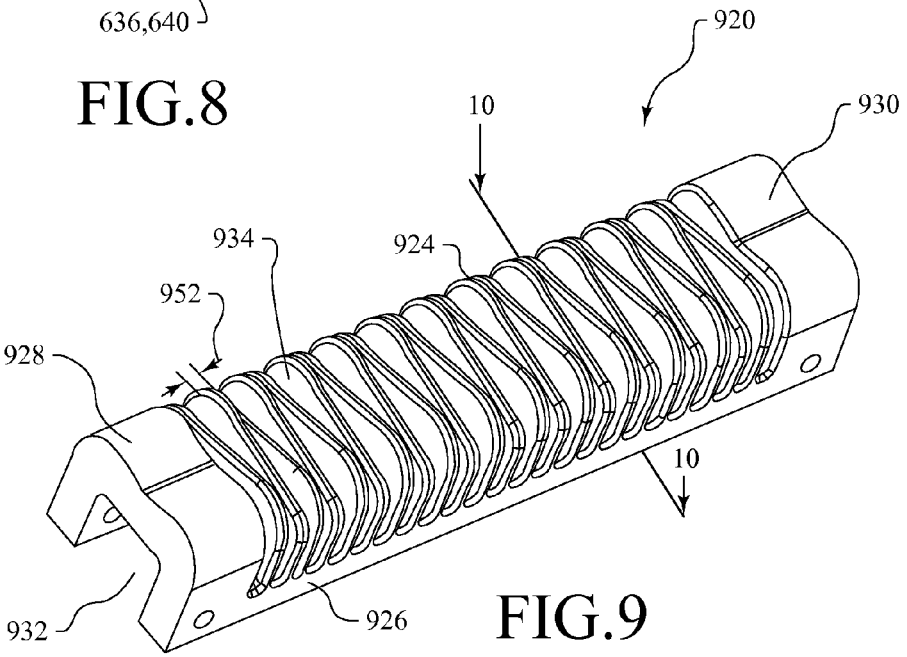
FIG. 9 is a perspective view depicting another alternative embodiment of an outer cutter, constructed in accordance with the teachings of this disclosure.
Figure 10:
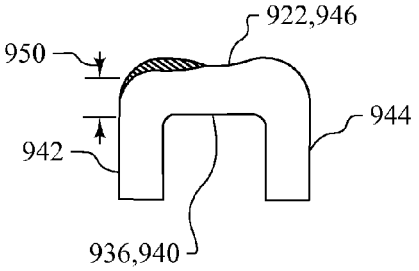
FIG. 10 is a cross-sectional view taken along line 10-10 of the outer cutter of FIG. 9, constructed in accordance with the teachings of this disclosure.

FIGS. 9-10 illustrate another alternative embodiment outer cutter 920. The outer cutter 920 is similar to the outer cutter 20 except the profile of the outer surface 922 of each outer cutter rib of the plurality of outer cutter ribs 924 differs from that of the outer cutter 20, and as such, will be described in more detail below. The outer cutter 920 includes an outer cutter frame 926. The outer cutter frame 926 includes first and second end sections 928, 930 with the plurality of outer cutter ribs 924 disposed therebetween. The outer cutter 920 includes a longitudinal passage 932, which operatively receives the liner inner cutter 24 (shown in FIG. 3). Each outer cutter rib 924 may be equally spaced apart so that an outer cutter slot 934 is formed between adjacent outer cutter ribs 924. Moreover, each outer cutter rib 924 includes an inward cutting surface 936 facing the longitudinal passage 932. The inward cutting surface 936 may include cutting edges 940.

The outer surface 922 of each outer cutter rib 924 includes a first and second side 942, 944 and a sloped glide surface 946 therebetween. The first side 942 may transition into the sloped glide surface 946 so that the intersection is arcuate. The second side 944 may transition into the sloped glide surface 946 so that the intersection is also arcuate. The sloped glide surface 946 inclines from the first side 942 toward the second side 944. The orientation of adjacent outer cutter ribs 924 alternate so that the first side 942 of one outer cutter rib 924 is proximate to the second side of an adjacent outer cutter rib while the second side 944 of the former outer cutter rib is proximate to first side of the adjacent outer cutter rib. Each outer cutter rib 924 has a depth 950 and a width 952. The depth 950 may be measured approximately from the inward cutting surface 936 to the sloped glide surface 946 adjacent the first side 942. The plurality of outer cutter ribs 924 of the outer cutter 920 may have a stubble trimmer value that is at least 3.

Figure 11:
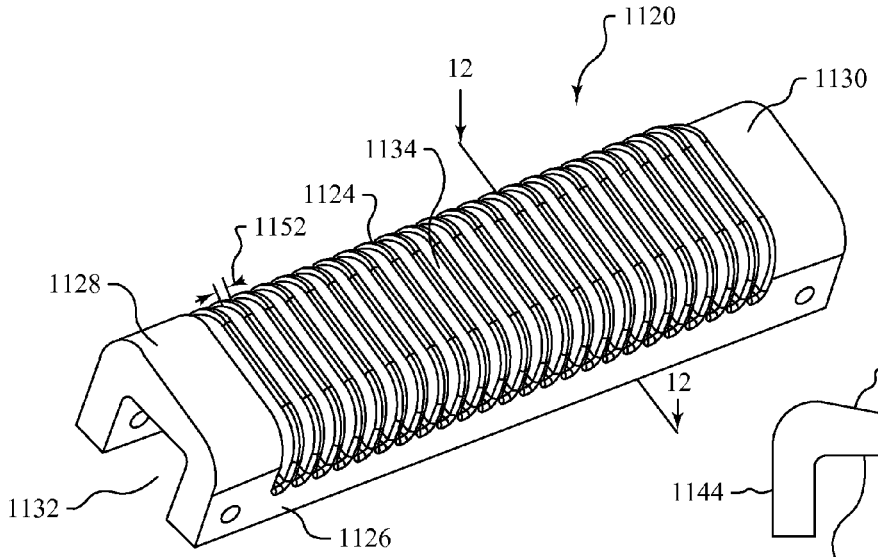
FIG. 11 is a perspective view depicting yet another alternative embodiment of an outer cutter, constructed in accordance with the teachings of this disclosure.
Figure 12:
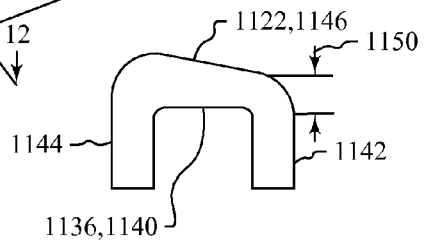
FIG. 12 is cross-sectional view taken along line 12-12 of the outer cutter of FIG. 11, constructed in accordance with the teachings of this disclosure.

FIGS. 11-12 illustrate yet another alternative embodiment outer cutter 1120. The outer cutter 1120 is similar to the outer cutter 20 except the profile of the outer surface 1122 of each outer cutter rib of the plurality of outer cutter ribs 1124 differs from that of the outer cutter 20, and as such, will be described in more detail below. The outer cutter 1120 includes an outer cutter frame 1126. The outer cutter frame 1126 includes first and second end sections 1128, 1130 with the plurality of outer cutter ribs 1124 disposed therebetween. The outer cutter 1120 includes a longitudinal passage 1132, which operatively receives the liner inner cutter 24 (shown in FIG. 3). Each outer cutter rib 1124 may be equally spaced apart so that an outer cutter slot 1134 is formed between adjacent outer cutter ribs 1124. Moreover, each outer cutter rib 1124 includes an inward cutting surface 1136 facing the longitudinal passage 1132. The inward cutting surface 1136 may include cutting edges 1140.

The outer surface 1122 of each outer cutter rib 1124 includes first and second sides 1142, 1144 and a sloped glide surface 1146 therebetween. The first side 1142 may transition into the sloped glide surface 1146 so that the intersection is arcuate. The second side 1144 may transition into the sloped glide surface 1146 so that the intersection is also arcuate. The sloped glide surface 1146 inclines from the first side 1142 toward the second side 1144. Each outer cutter rib 1124 has a depth 1150 and a width 1152. The depth 1150 may be measured approximately from the inward cutting surface 1136 to the sloped glide surface 1146 adjacent the first side 1142. The plurality of outer cutter ribs 1124 of the outer cutter 1120 may have a stubble trimmer value that is at least 3.

Figure 13:
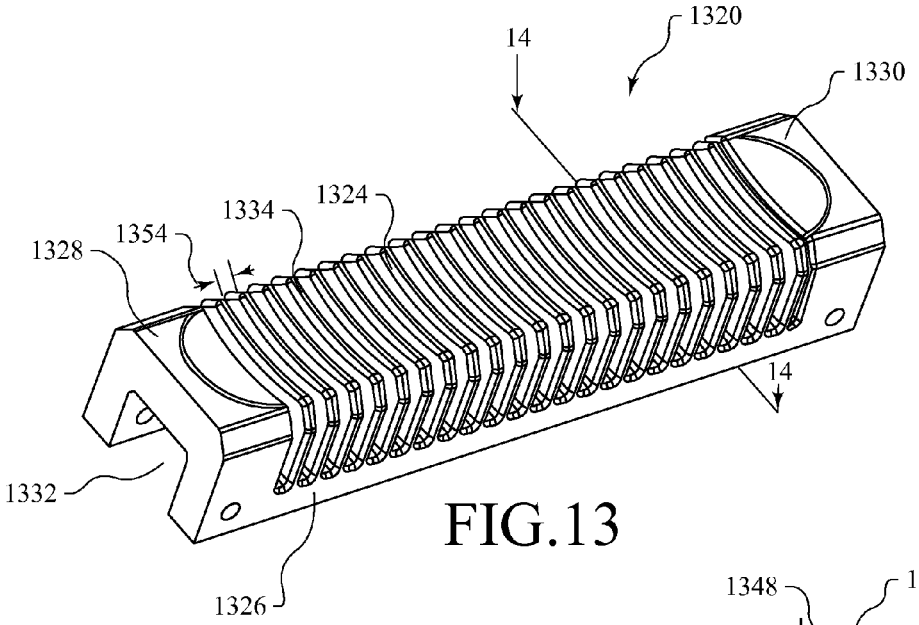
FIG. 13 is a perspective view depicting still yet another alternative embodiment of an outer cutter, constructed in accordance with the teachings of this disclosure.
Figure 14:
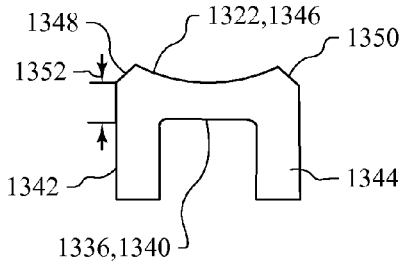
FIG. 14 is a cross-sectional view taken along line 14-14 of the outer cutter of FIG. 13, constructed in accordance with the teachings of this disclosure.

FIGS. 13-14 illustrate still yet another alternative embodiment outer cutter 1320. The outer cutter 1320 is similar to the outer cutter 20 except the profile of the outer surface 1322 of each outer cutter rib of the plurality of outer cutter ribs 1324 differs from that of the outer cutter 20, and as such, will be described in more detail below. The outer cutter 1320 includes an outer cutter frame 1326. The outer cutter frame 1326 includes first and second end sections 1328, 1330 with the plurality of outer cutter ribs 1324 disposed therebetween. The outer cutter 1320 includes a longitudinal passage 1332, which operatively receives the liner inner cutter 24 (shown in FIG. 3). Each outer cutter rib 1324 may be equally spaced apart so that an outer cutter slot 1334 is formed between adjacent outer cutter ribs 1324. Moreover, each outer cutter rib 1324 includes an inward cutting surface 1336 facing the longitudinal passage 1332. The inward cutting surface 1336 may include cutting edges 1340.

The outer surface 1322 of each outer cutter rib 1324 includes first and second sides 1342, 1344 and a concaved glide surface 1346 therebetween. The first side 1342 includes a first chamfer 1348, which is coupled to the concaved glide surface 1346. Similarly, the second side 1344 includes a second chamfer 1350, which is also coupled to the concaved glide surface 1346. The concaved glide surface 1346 curves inwardly toward the inward cutting surface 1336. Each outer cutter rib 1324 has a depth 1352 and a width 1354. The depth 1352 may be measured approximately from the inward cutting surface 1336 to the concaved glide surface 1346. The plurality of outer cutter ribs 1324 of the outer cutter 1320 includes a stubble trimmer value that is at least 3.

During operation of the electric trimmer 10, the linear inner cutter 22 reciprocates with respect to the stationary outer cutter 20 so that the plurality of inner cutter ribs 28 mechanically associate in a shearing motion with the plurality of outer cutter ribs 64. As an example of a trimming pass of the electric trimmer 10 gliding across a user's face, hairs may be guided through the outer cutter slots 68 to be sheared off by the reciprocating motion of the plurality of inner cutter ribs 28 mechanically associating with the stationary outer cutter ribs 28. The depth 88 of each outer cutter rib 28 provides the user with a uniform layer of stubble while ensuring that the user's skin avoids any contact with inner cutter ribs 28 to avoid any skin nicking.

Referring back to FIGS. 1-2, the protective casing 16 may include a detachable hair pocket 1380 to capture the trimmed hair. Moreover, guidance stops 1382 are disposed adjacent to each of the first and second arms 48, 50. Minor clearance gaps 1384 are located between the guidance stops 1382 and the casing 16. As the electric trimmer 10 glides against a user's face, the minor clearance gaps 1384 allow the linear cutter 18 to tilt, with respect to the casing 16, up to point where either guidance stop 1382 comes to rest on the casing 16 and prevents the linear cutter 18 from tilting further. The tilt angle of the linear cutter 18 may be approximately three degrees in either direction.

While the present disclosure has shown and described details of exemplary embodiments, it will be understood by one skilled in the art that various changes in detail may be effected therein without departing from the spirit and scope of the disclosure as defined by claims supported by the written description and drawings. Further, where these exemplary embodiments (and other related derivations) are described with reference to a certain number of elements it will be understood that other exemplary embodiments may be practiced utilizing either less than or more than the certain number of elements.

INDUSTRIAL APPLICABILITY

Based on the foregoing, it can be seen that the present disclosure sets forth an electric trimmer that simplifies the hair trimming experience. The teachings of this disclosure can be employed to trim a beard that results in a uniform layer of stubble on any facial contour while eliminating the potential of nicking the skin. Moreover, through the novel teachings set forth above, trimming a beard can be achieved with a unitary trimmer in an easier and more efficient manner without requiring any additional comb attachments.

What is claimed is:

1. An outer cutter for an electric trimmer, the outer cutter comprising:
   - a frame having first and second end sections; and
   - a plurality of outer cutter ribs disposed between the first and second end sections, each outer cutter rib of the plurality of outer cutter ribs including a cutting surface and an outer surface, the outer surface including a glide surface disposed between first and second sides of the outer surface, the cutting surface facing a longitudinal passage of the outer cutter, wherein the plurality of outer cutter ribs has a stubble trimmer value of at least 3.

2. The outer cutter of claim 1, wherein the cutting surface includes at least a first cutting edge.

3. The outer cutter of claim 1, wherein the glide surface is parallel to the cutting surface.

4. The outer cutter of claim 1, wherein the first side transitions into the glide surface arcuately, the second side includes a notch that transitions into the glide surface, the glide surface inclines from the first side to the notch, wherein adjacent outer cutter ribs of the plurality of outer cutter ribs are alternately orientated so that the first and second sides of one outer cutter rib is proximate the second and first sides of its adjacent outer cutter rib, respectively.

5. The outer cutter of claim 1, wherein the first side transition into the glide surface arcuately, the second side transitions into the glide surface arcuately, the glide surface inclines from the first side to the second side.

6. The outer cutter of claim 5, wherein adjacent outer cutter ribs of the plurality of outer cutter ribs are alternately orientated so that the first and second sides of one outer cutter rib is proximate the second and first sides of its adjacent outer cutter rib, respectively.

7. The outer cutter of claim 1, wherein the first side includes a first chamfer coupled to the glide surface, the second side includes a second chamfer coupled to the glide surface, the glide surface curves inwardly toward the cutting surface.

* * * * *